US008709697B2

(12) United States Patent
Norikane et al.

(10) Patent No.: US 8,709,697 B2
(45) Date of Patent: Apr. 29, 2014

(54) METHOD OF MANUFACTURING TONER

(75) Inventors: Yoshihiro Norikane, Yokohama (JP); Yohichiroh Watanabe, Fuji (JP); Masaru Ohgaki, Yokohama (JP); Shinji Aoki, Yokohama (JP); Yasutada Shitara, Numazu (JP); Andrew Mwaniki Mulwa, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 339 days.

(21) Appl. No.: 12/834,427

(22) Filed: Jul. 12, 2010

(65) Prior Publication Data

US 2011/0014565 A1 Jan. 20, 2011

(30) Foreign Application Priority Data

Jul. 16, 2009 (JP) ..... 2009-168131

(51) Int. Cl.
*G03G 9/08* (2006.01)

(52) U.S. Cl.
USPC ..... 430/137.1; 430/137.14; 430/137.11; 430/137.13

(58) Field of Classification Search
USPC ..... 430/137.1–137.21, 106.1–111.41, 430/137.14, 137.13, 137.11
See application file for complete search history.

(56) References Cited

U.S. PATENT DOCUMENTS

2002/0180123 A1* 12/2002 Kawasaki ..... 266/202
2008/0063971 A1* 3/2008 Watanabe et al. ..... 430/110.4
2008/0227011 A1 9/2008 Kuramoto et al.
2008/0241727 A1 10/2008 Norikane et al.
2008/0248416 A1 10/2008 Norikane et al.
2008/0286679 A1 11/2008 Norikane et al.
2008/0286680 A1 11/2008 Norikane et al.
2008/0292985 A1 11/2008 Suzuki et al.
2009/0117486 A1 5/2009 Watanabe et al.
2009/0170018 A1 7/2009 Kuramoto et al.
2009/0226837 A1 9/2009 Norikane et al.

(Continued)

FOREIGN PATENT DOCUMENTS

JP 2003-262976 9/2003
JP 2003262977 A * 9/2003

(Continued)

OTHER PUBLICATIONS

English abstract and translation of JP 2003-262977 A, Tejima et. al, Sep. 2003.*

(Continued)

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

A method of manufacturing a toner including supplying a fluid containing a resin and a coloring agent to a retaining member including a film having multiple discharge orifices, discharging droplets of the fluid from the multiple discharge orifices at a speed of from 2 to 4 m/s by applying a pulse voltage having a trapezoid waveform to a piezoelectric body having a surface provided substantially parallel to the film to move the surface in a direction away from the film relative to a reference position of the surface followed by holding the surface there for a predetermined time, and bringing the surface back to the reference position; and solidifying droplets of the fluid discharged from the multiple discharge orifices to form mother particles.

15 Claims, 5 Drawing Sheets

(56) References Cited

U.S. PATENT DOCUMENTS

| | | | | |
|---|---|---|---|---|
| 2009/0239170 | A1 | 9/2009 | Honda et al. | |
| 2009/0317738 | A1 | 12/2009 | Honda et al. | |
| 2009/0325100 | A1 | 12/2009 | Watanabe et al. | |
| 2010/0003613 | A1 * | 1/2010 | Honda et al. | 430/110.4 |
| 2010/0021209 | A1 | 1/2010 | Watanabe et al. | |
| 2010/0055600 | A1 | 3/2010 | Norikane et al. | |
| 2010/0227267 | A1 | 9/2010 | Shitara et al. | |

FOREIGN PATENT DOCUMENTS

| | | | |
|---|---|---|---|
| JP | 2003-280236 | A | 10/2003 |
| JP | 2006-794 | A | 1/2006 |
| JP | 3786035 | | 3/2006 |
| JP | 2007-199463 | | 8/2007 |
| JP | 4155116 | | 7/2008 |
| JP | 2008-242416 | | 10/2008 |
| JP | 2009-37216 | A | 2/2009 |

OTHER PUBLICATIONS http://mathworld.wolfram.com/SquareWave.html, 1999-2013 Wolfram Research, Inc., Champaign, IL.*

U.S. Appl. No. 12/784,906, filed May 21, 2010, Honda, et al.

Japanese Office Action issued Jun. 11, 2013, in patent Application No. 2009-168131.

* cited by examiner

METHOD OF MANUFACTURING TONER

BACKGROUND OF THE INVENTION

1. Field of the Invention

The present invention relates to a method of manufacturing a toner.

2. Discussion of the Background

Development agents for use in developing latent electrostatic images produced in electrophotography, electrostatic recording, electrostatic printing, etc., are, for example, temporarily attached to a latent electrostatic image bearing member on which a latent electrostatic image is formed, and then transferred from the latent electrostatic image bearing member to a transfer medium followed by fixing.

Two-component development agents containing a carrier and a toner, and single-component development agents (magnetic toner, non-magnetic toner) without requiring a carrier are known as such development agents.

Such a toner can be manufactured by, for example, a pulverization method. However, the pulverization method has a problem with regard to inconsistency or variation in the toner form, and wide particle diameter distribution.

In recent years, polymerization methods such as suspension polymerization, emulsification polymerization agglomeration, solution suspension, and ester elongation polymerization, have been widely diffused.

However, the polymerization method presumes that a dispersant is used in an aqueous medium. This causes a problem in that the dispersant that degrades the charging characteristics remains on the surface of the toner and thus has an adverse impact on environment stability. In addition, a large quantity of water is required for washing away the dispersant.

Additionally, a toner can be also manufactured using a spray drying method. However, like the pulverization method, the spray drying method also has a problem with regard to inconsistency or variation of the toner form, and particle diameter distribution.

Unexamined published Japanese patent application publication No. 2003-262976 (JP-2003-262976-A) describes a toner manufacturing device having a head that discharges a fluid material and a solidification unit that solidifies and granulates the fluid material discharged from the head. The head includes a material retainer, a piezoelectric body that imparts pressure pulses to the material retained in the retainer, and a discharging unit that discharges the material by the pressure pulses.

The material retainer includes a vibration plate vibrated by the vibration of the piezoelectric body, and the vibration plate bends in conjunction with the deformation of the piezoelectric body to diminish the inner volume of the material retainer. As a result, the pressure in the material retainer instantly increases, thereby discharging the particle-like material from the discharging unit. However, such a discharging unit has a problem, in that the particle size distribution of the resultant toner broadens unacceptably if the material is discharged by a single piezoelectric body through multiple discharging units.

SUMMARY OF THE INVENTION

For these reasons, the present inventors recognize that a need exists for a method of manufacturing a toner having a narrow particle size distribution. Accordingly, an object of the present invention is to provide a method of manufacturing a toner having a narrow particle size distribution.

Briefly, this object and other objects of the present invention as hereinafter described will become more readily apparent and can be attained, either individually or in combination thereof, by a method of manufacturing a toner including supplying a fluid containing a resin and a coloring agent to a retaining member including a film having multiple discharge orifices therein, discharging droplets of the fluid from the multiple discharge orifices at a speed of from 2 to 4 m/s by applying a pulse voltage having a trapezoid waveform to a piezoelectric body having a surface portion provided substantially parallel to the film to move the surface in a direction away from the film relative to an at-rest reference position of the surface, holding the surface thereat for a predetermined time, and bringing the surface back to the reference position; and solidifying droplets of the fluid discharged from the multiple discharge orifices to form mother particles.

It is preferred that, in the method of manufacturing a toner mentioned above, the pulse voltage having a trapezoid waveform has a frequency smaller than a resonance frequency of the film.

It is still further preferred that, in the method of manufacturing a toner mentioned above, a flow of gas is formed outside the retaining member such that the gas flows in substantially the same direction as a direction of the fluid discharged from the multiple discharge orifices and is restricted by a restricting member provided near the multiple discharge orifices.

It is still further preferred that, in the method of manufacturing a toner mentioned above, the fluid further contains an organic solvent and the droplets discharged from the multiple discharge orifices are dried by removing the organic solvent.

It is still further preferred that the method of manufacturing a toner mentioned above includes transferring the droplets of the fluid discharged from the multiple discharge orifices by using a drying gas flowing in substantially the same direction as a direction of discharging the droplets.

It is still further preferred that, in the method of manufacturing a toner mentioned above, the mother particles have a ratio (D4/Dn) of a weight average particle diameter D4 to a number average particle diameter Dn of from 1.00 to 1.15.

It is still further preferred that, in the method of manufacturing a toner mentioned above, the mother particles have a weight average particle diameter D4 of from 1 to 20 μm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be described below in detail with reference to several embodiments and accompanying drawings.

Figure 1:
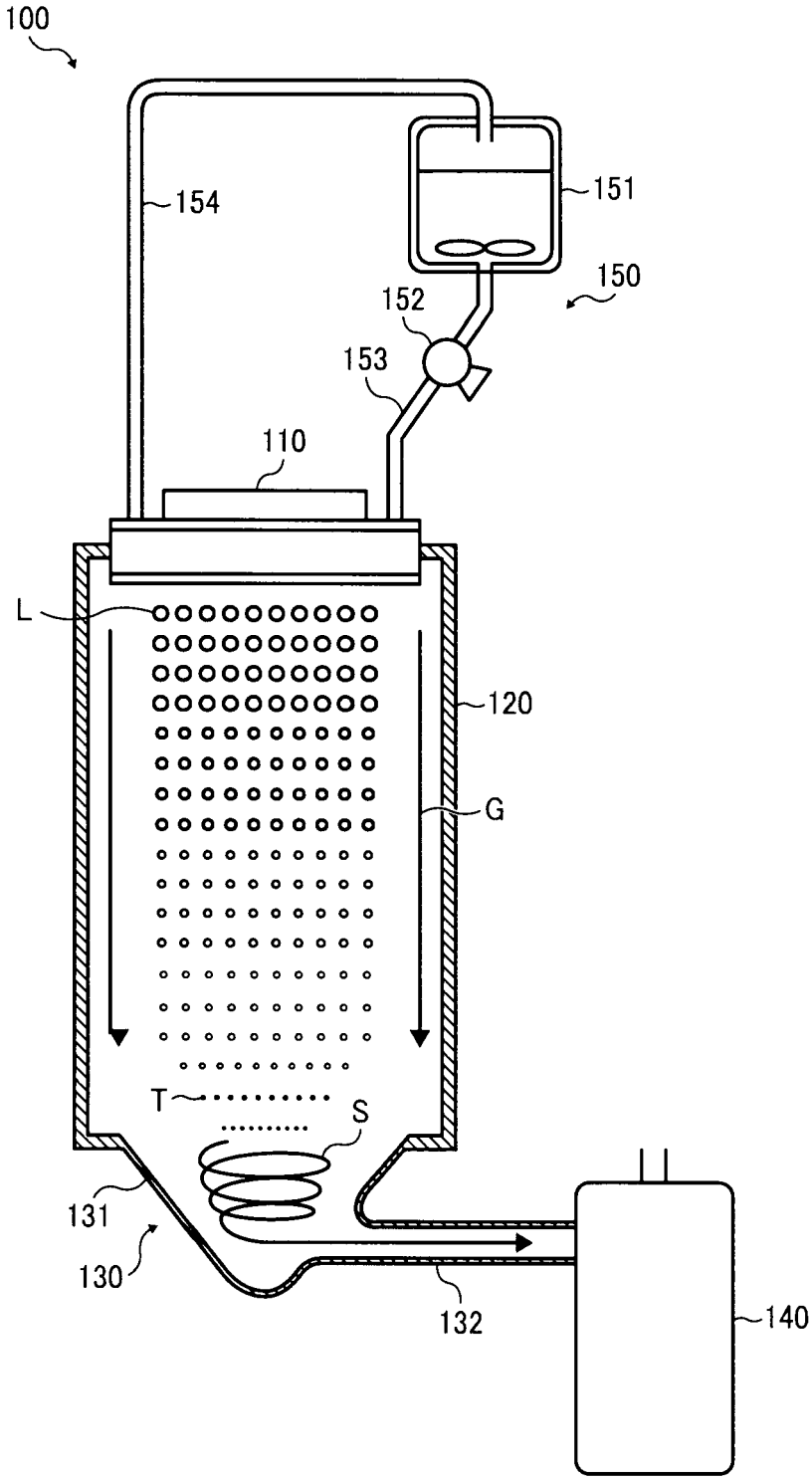
FIG. 1 is a diagram illustrating an example of a device for manufacturing a toner for use in the present invention.

FIG. 1 is a diagram illustrating an example of the toner manufacturing device for use in the present invention.

A toner manufacturing device 100 includes a droplet discharging unit 110, a drying tower 120, a collection unit 130, a retainer 140 and a supplying unit 150. The droplet discharging unit 110 discharges toner liquid material (fluid) in which a toner material containing a resin and a coloring agent is dissolved or dispersed in an organic solvent. The drying tower 120 is arranged below the droplet discharging unit 110 and dries droplets L discharged from the droplet discharging unit 110 with a drying gas G to form mother particles T. The collection unit 130 collects the mother particles T. The retainer 140 retains the mother particles T collected in the collection unit 130. The supplying unit 150 supplies the toner liquid material to the droplet discharging unit 110.

The drying gas G represents a gas having a dew point of −10° C. or lower under atmospheric pressure.

Figure 2A:
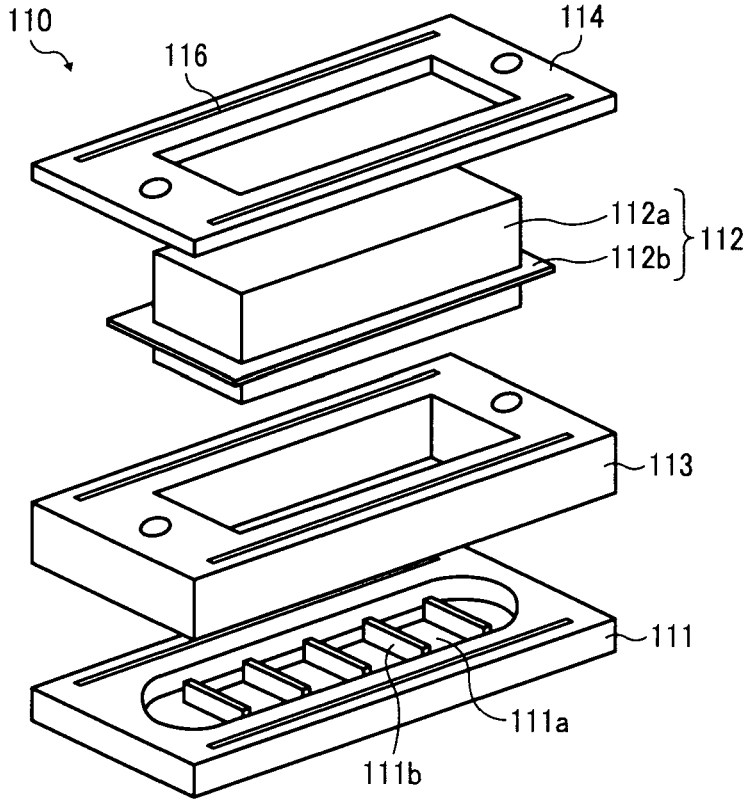
FIGS. 2A and 2B are exploded perspective and lateral cross-sectional diagrams, respectively, illustrating a droplet discharging unit of FIG. 1.
Figure 2B:
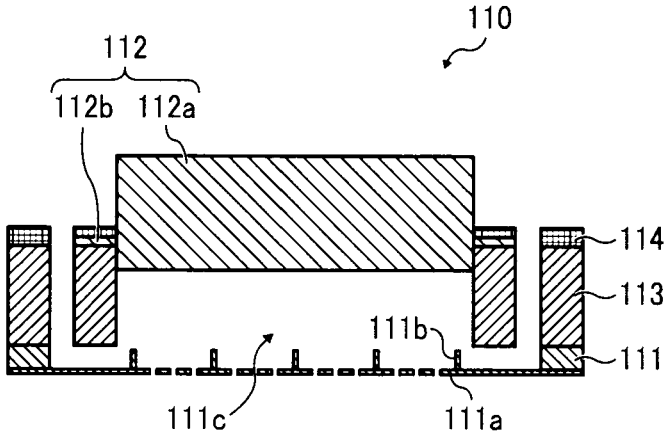
Figure 3:
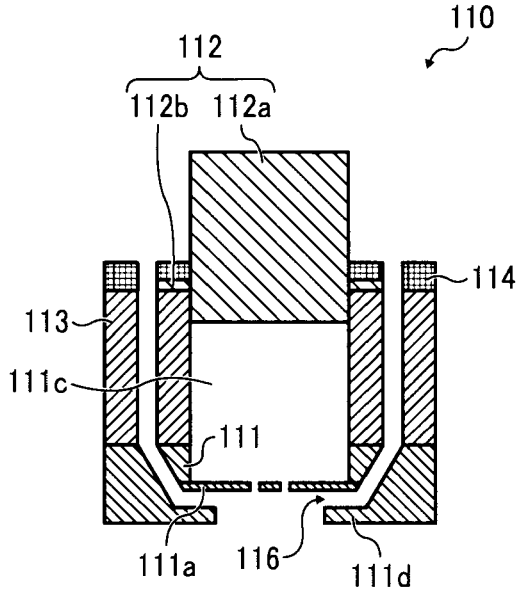
FIG. 3 is a longitudinal cross-sectional view of the droplet discharging unit of FIGS. 2A and 2B.

FIGS. 2 and 3 are diagrams illustrating the droplet discharging unit 110. FIGS. 2A and 2B are an assembling view and a cross section of the droplet discharging unit 110, respectively. The droplet discharging unit 110 includes a thin film 111*a* having multiple discharge orifices, a retaining member 111 that retains toner liquid material, and a vibration applicator 112 that applies vibration to the toner liquid material filled in the retaining member 111.

The thin film 111*a* is attached to the retaining member 111 with a resin insoluble in an organic solvent contained in the toner liquid material. The retaining member 111 is formed of multiple retainer areas 111*c* via multiple shields 111*b*. The toner liquid material is supplied to and discharged from the multiple retainer areas 111*c* through a pipe 153 and a pipe 154 (FIG. 1).

There is no specific limit to the selection of the material that forms the thin film 111*a* as long as the material is sufficiently elastic. Specific examples thereof include, but are not limited to, nickel, nickel alloy, SUS, silicon, and silicon oxide. Among these, silicon and silicon oxide are preferable because these are suitable to accurately form a discharge orifice having a large aspect ratio.

The discharge orifice of the thin film 111*a* is formed by, for example, an electrocasting method, or a silicon process.

In addition, the discharge orifice can be formed by punching holes.

The thin film 111*a* typically has a thickness of from 10 to 50 μm, and an opening size of the discharge orifice of from 4 to 15 μm.

When the film thickness is too thin, the thin film 111*a* tends to become soft. To the contrary, when the film thickness is too thick, discharging the toner liquid material tends to become difficult.

When the opening size of the discharge orifice is too small, the coloring agent contained in the toner liquid material easily adheres to the discharge orifice, thereby making it difficult to keep discharging the toner liquid material stably. When the opening size of the discharge orifice is too large, manufactured mother toner particles T tend to have a broad particle size distribution.

The opening size of the discharge orifice represents a diameter if the form of the discharge orifice is a true circle, and a minor axis if it is an ellipse.

The shield 111*b* is attached to the thin film 111*a* with a resin insoluble in an organic solvent contained in the toner liquid material.

Any material that is insoluble in the organic solvent contained in the toner liquid material can be used as the material for the shield 111*b*. For example, metals and ceramics are suitably used.

In addition, 10 to 10,000 discharge orifices are formed in the retaining area 111*c*.

When the number of the discharge orifices is too small, the productivity tends to decrease. When the number of discharge orifices is too large, manufactured mother toner particles T tend to have a broad particle size distribution.

A support (not shown) is attached to the retaining member 111 and thus, the droplet discharging unit 110 is held at the ceiling portion of the drying tower 120.

The droplet discharging unit 110 can be held at the side or bottom of the drying tower 120.

The vibration applicator 112 has a piezoelectric body 112*a* having a plane parallel to the thin film 111*a*. When a pulse voltage having an trapezoid waveform is applied between the electrodes of the piezoelectric body 112*a*, the vibration applicator 112 vibrates periodically.

As a result, periodic pressure vibration is applied to the toner liquid material supplied to the retaining member 111. Then, the toner liquid material is discharged from the multiple discharge orifices at a speed of from 2 to 4 m/s. When the speed is too slow, the coloring agent contained in the toner liquid material is easily deposited at the thin film 111*a*, thereby making it difficult to keep discharging the toner liquid material stably. When the speed is too fast, manufactured mother toner particles T tend to have a broad particle size distribution.

The pulse voltage having an trapezoid waveform is preferably less than the resonance vibration frequency of the thin film 111*a*.

When this is satisfied, the periodic pressure vibration can be uniformly applied to the toner liquid material supplied to the retaining member 111. The resonant vibration frequency of the thin film 111*a* can be measured by a laser Doppler measuring method.

Figure 4:
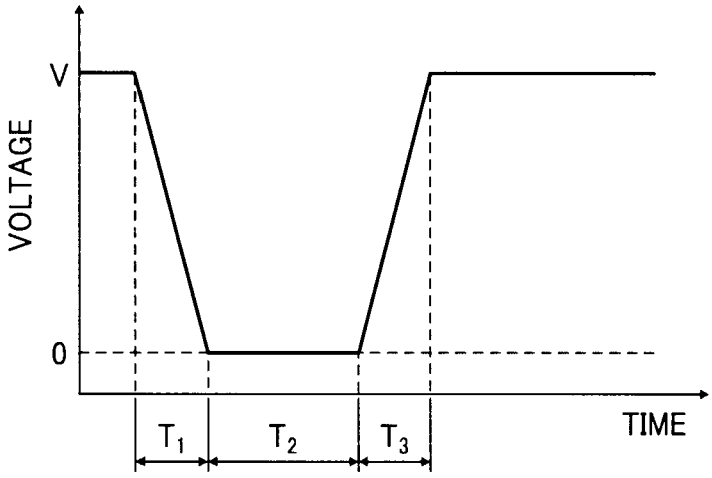
FIG. 4 is a graph illustrating a pulse voltage having a trapezoid waveform that is applied to a piezoelectric body of FIGS. 2 and 3.

FIG. 4 is a graph illustrating a pulse voltage having a trapezoid waveform that is applied to the piezoelectric body 112*a*.

The pulse voltage is basically that the voltage is down from the reference voltage V to 0 in the time $T_1$, sustained at 0 for the time $T_2$, and then back to the reference voltage V in the time $T_3$. During the application of the pulse voltage, the piezoelectric body 112*a* is drawn from the reference position, which is away from the thin film 111*a*, and thus the toner liquid material is drawn as well (refer to FIG. 5A).

Figure 5B:
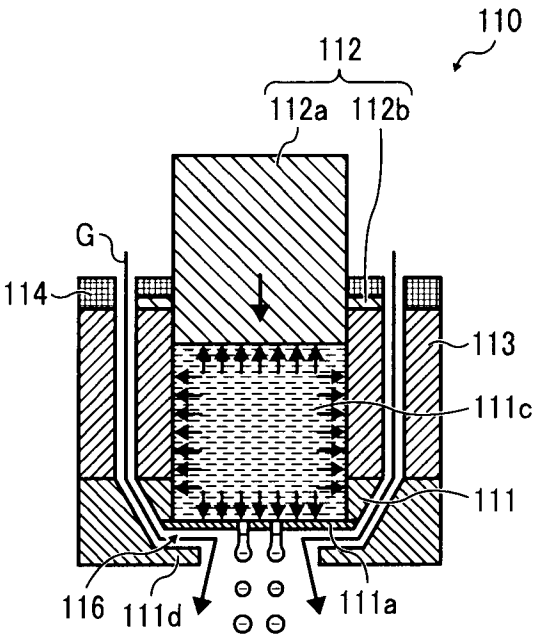
FIGS. 5A and 5B are cross-sectional views of a mechanism of forming droplets in the droplet discharging unit of FIG. 1.
Figure 5A:
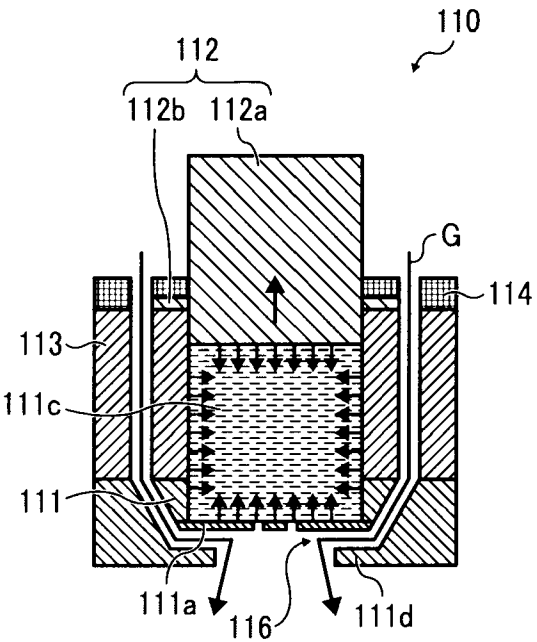

Then, after the piezoelectric body 112*a* and the toner liquid material are sustained in the drawn state for the time $T_2$, the piezoelectric body 112*a* is back to the reference position in the time $T_3$, thereby discharging the toner liquid material from the multiple discharge orifices (Refer to FIG. 5B).

A combination of this basic pulse voltage and another pulse voltage having a trapezoid waveform can be applied to the piezoelectric body 112*a*, if desired.

When the primary resonance frequency of the piezoelectric body 112*a* in the droplet discharging unit 110 is represented by f, the following relationship is preferably satisfied: $N-0.1 \leq 4fT_1 \leq N+0.1$ (N represents an integer).

The piezoelectric body 112*a* is efficiently vibrates when the relationship is satisfied, The vibration applicator 112 can be provided to each retainer area 111*c*.

There is no specific limit to the selection of the piezoelectric body 112*a*. Piezoelectric ceramics such as lead zirconate titanate (PZT) are suitably used. Piezoelectric ceramics are typically laminated for usage since the variation of the vibration is small.

Specific other examples thereof include, but are not limited to, piezoelectric polymers such as polyvinylidene fluoride (PVDF), and piezoelectric single quartz material such as crystal, $LiNbO_3$, $LiTaO_3$, and $KNbO_3$.

In addition, bolt-on Langevin type transducer is preferable as the piezoelectric body 112*a* since the piezoelectric ceramics are mechanically connected and have a high mechanical strength.

Thereby, the piezoelectric body 112*a* becomes strong for breakage when vibrated at a high amplitude.

A vibration separation member 113 is provided between the retaining member 111 and the vibration applicator 112 not to convey vibration. The vibration applicator 112 is fixed by connecting the vibration separation member 113 and a fixing member 114 via a node 112*b*, which has a small vibration amplitude.

Any elastic material insoluble in the organic solvent contained in the toner liquid material can be used as the material for the vibration separation member. For example, silicone based additives (for example, SIFEL (manufactured by Shin-Etsu Silicones) are suitably used. The vibration applicator 112 can be fixed without the vibration separation member 113 by sandwiching the node 112*b* by the retaining member 111 and the fixing member 114.

In addition, the droplet discharging unit 110 has a flow passage 116 that supplies the drying gas G in the substantially same direction as the direction of discharging the toner liquid material.

Therefore, the droplet L discharged from the multiple discharge orifices is dried rapidly. As a result, the solution L is prevented from merging.

The flow passage 116 has a restricting member 111*d* that squeezes the flow of the drying gas G near the multiple discharge orifices.

There is no specific limit to the selection of the drying gas G. Air or nitrogen is suitably used.

Figure 6:
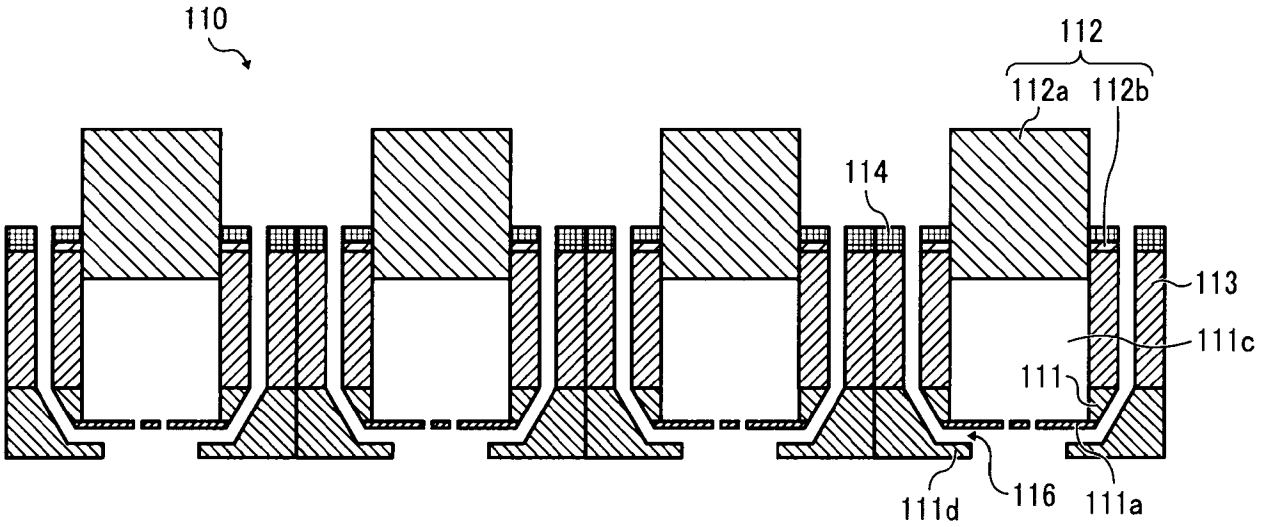
FIG. 6 is a diagram illustrating a cross-section of the droplet discharging unit of FIG. 1.
Figure 7:
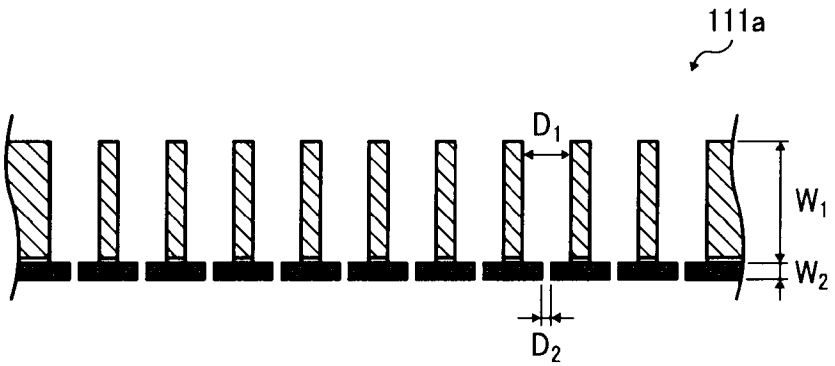
FIG. 7 is a cross-sectional view of thin films of Examples described later.

In FIG. 1, one droplet discharging unit 110 is provided on the drying tower 120. As illustrated in FIG. 6, a plurality of the droplet discharging units 110 can be provided to the drying tower 120. The number of the droplet discharging units 110 provided to the drying tower 120 is preferably from 1,000 to 10,000. When the number of the droplet discharging units 110 is too small, the productivity of manufacturing toner tends to decrease. When the number of droplet discharging units 110 is too large, control of the droplet discharging units 110 may become difficult.

The toner liquid material is supplied from a tank 151 via the tube 153 to the retainer area 111*c* for a plurality of the droplet discharging units 110 as seen in FIG. 1.

In the drying tower 120, the droplet L discharged from the droplet discharging unit 110 is dried to form the mother particle T by using the drying gas G flowing in the significantly same direction as the discharging direction of the toner liquid material.

The collection unit 130 is provided on the immediate downstream side of the drying tower 120 relative to the transfer direction of the mother particle T and has a tapered surface 131 which has an opening size gradually reducing from the upstream to the downstream. Furthermore, an eddy S occurs flowing from the upstream to the downstream in the collection unit 130 by suction by a suction pump (not shown). Therefore, the mother particle T is collected and transferred via a tube 132 to the retainer 140 in which the mother particle T is retained. The mother particle T can be transferred by application of a pressure from the collection unit 130 to the retainer 140 or suctioned from the retainer side.

The supplying unit 150 forms a circulating system which includes a tank 151 that retains the toner liquid material, a pump 152 that supplies the toner liquid material with pressure, the tube 153 that supplies the toner liquid material to the droplet discharging unit 110, and the tube 154 that discharges the toner liquid material from the droplet discharging unit 110.

When the toner liquid material is discharged from the droplet discharging unit 110, the toner liquid material is self-fed from the tank 151 to the droplet discharging unit 110. When the toner manufacturing device 100 is in operation, the toner liquid material is supplied to the droplet discharging unit 110 by an assistance of the pump 152.

In addition, the tube 154 discharges air bubble in the toner liquid material.

Methods of manufacturing a toner using the toner manufacturing device 100 are described next.

First, the piezoelectric body 112*a* periodically vibrates by applying a pulse voltage having a trapezoid waveform to the piezoelectric body 112a of the vibration applicator 112 in the state in which the toner liquid material is supplied to the retaining member 111 of the droplet discharging unit 110.

Then, the vibration of the surface provided substantially parallel to the thin film 111*a* of the piezoelectric body 112*a* is conveyed to the toner liquid material in the retainer retaining member 111 so that the pressure varies periodically. Therefore, the toner liquid material is discharged from the multiple discharge orifices.

The droplet L discharged in the drying tower 120 is transferred by the drying gas G flowing in the significantly same direction as the discharging direction of the toner liquid material. Therefore, the organic solvent is removed and thus the mother particle T is formed. Furthermore, the mother particle T is collected at the collection unit 130 situated on the downstream side of the drying tower 120 using the eddy S and transferred to and retained in the retainer 140.

As a result, the mother particle T having a ratio of the weight average particle diameter to the number average particle diameter of from 1.00 to 1.15 can be manufactured. As a result, the mother particle T having a weight average particle diameter of from 1 to 20 μm can be manufactured.

Since the multiple discharge orifices are formed on the droplet discharging unit 110, multiple droplets L are continuously discharged, resulting in drastic improvement on the productivity of toner. Furthermore, clogging of the discharge orifice caused by attachment of the coloring agent contained in the toner liquid material to the thin film 111*a* is prevented, which leads to stable manufacturing of the toner.

In this embodiment, the mother particle T is formed by dissolving or dispersing toner material containing a binder resin and the coloring agent in a solvent followed by formation of droplets in the droplet discharging unit 110 and the droplet L is dried at the drying tower 120 to form the mother particle T. Alternatively, the droplet L can be cured at the drying tower 120 by using the toner material containing a curable resin. In addition, it is also suitable that the toner liquid material using the droplet discharging unit 110 where the droplets of the melted toner material are formed is discharged and then the droplets are cooled down to form the mother particle T.

Next, the toner liquid material is described.

The toner liquid material is obtained by dissolving or dispersing a toner material containing a resin, a coloring agent, an optional wax, and an optional magnetic substance in a solvent. The toner material can be obtained by mixing and kneading materials with a high shearing dispersion device such as a three roll mill.

There is no specific limit to the selection of the solvent that dissolves or disperses a toner material. Ethyl acetate, toluene, methylethyl ketone, etc., are suitably used. These can be used singly or in combination.

There is no specific limit to the selection of the resin. Specific examples thereof include, but are not limited to, vinyl polymers such as styrene-based resins, (meth)acrylate-based resins, and styrene-(meth)acrylate-based resins, polyesters, polyol resins, phenol resins, silicone resins, polyurethane resins, polyamide resins, furan resins, epoxy resins, xylene resins, terpene resins, coumarone-indene resins, polycarbonate resins, and petroleum-based resins. These can be used singly or in combination.

There is no specific limit to the selection of the monomer for use in synthesis of the vinyl polymer.

Specific examples thereof include, but are not limited to, styrene or styrene-based monomers such as o-methyl styrene, m-methyl styrene, p-methyl styrene, p-ethyl styrene, 2,4-dimethyl styrene, p-n-amyl styrene, p-tert-butyl styrene, p-n-hexyl styrene, p-n-octyl styrene, p-n-nonyl styrene, p-n-decyl styrene, p-n-dodedecyl styrene, p-methoxy styrene, p-chloro styrene, 3,4-dichloro styrene, m-nitro styrene, o-nitro styrene, and p-nitro styrene; acrylic acid and acryl-based monomers such as methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate; methacrylic acid and methacryl-based monomers such as methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and methacrylate and diethylaminoethyl methacrylate; mono-olefins such as ethylene, propylene, butylene, and isobutylene; polyenes such as butadiene, and isoplene; vinyl halides such as vinyl chloride, vinylidene chloride, vinyl bromide vinyl fluoride; vinyl esters such as vinyl acetate, vinyl propionate, and vinyl benzoate; vinyl ketones such as vinylmethyl ether, vinylethyl ether, and vinylisobutyl ether; vinylketones such as vinylmethylketone, vinylhexyl ketone, and methylisopropenyl ketone; N-vinyl pyrrole, N-vinylcarbazole, N-vinyl indol, N-vinyl pyrolidone; vinyl naphthalenes; (meth)acrylic acid derivatives such as acrylonitrile, methacrylonitrile, and acryl amides; unsaturated dibasic acid or anhydrides thereof such as maleic acid, citraconic acid, itaconic acid, alkenyl succinic acid, fumaric acid, and mesaconic acid; monoesters of unsaturated dibasic acid such as monomethyl malate, monoethyl malate, monobutyl malate, monomthyl citracoate, monomethyl itacoate, monomethyl alkenyl succinate, monomethyl fumarate, and monomethyl mesaconate; diesters of unsaturated dibasic acids such as dimethyl malate, and dimethyl fumarate; α,β-unsaturated acid such as crotonic acid, and cinnamic acid, anhydrides thereof, or anhydrides with a lower apliphatic acid; alkenyl maroic acid, alkenyl glutaric acid, and alkenyl adipic acid, and anhydrides thereof, or monoesters thereof; hydroxy alkylesters of (meth)acrylic acid such as acrylic acid 2-hydroxyl ethyl, methacrylic acid 2-hydroxyl ethyl, and methacrylic acid 2-hydroxyl propyl; and monomers having a hydroxy group such as 4-(1-hydroxy-1-methylbutyl)styrene, and 4-(1-hydroxy-1-methylmexyl)styrene. These can be used alone or in combination.

Vinyl polymers can be cross-linked with a cross-linking agent having two or more vinyl groups when synthesizing a vinyl polymer.

There is no specific limit to the selection of the cross-linking agent having two functional groups. Specific examples thereof include, but are not limited to, aromatic divinyl compounds such as divinyl benzene and divinyl naphthalene; di(meth)acrylate compounds bonded by an alkylene group such as ethylene glycol di(meth)acrylate, 1,3-butylene glycol di(meth)acrylate, 1,4-butanediol di(meth)acrylate, 1,5-pentanediol di(meth)acrylate, 1,6-hexanediol di(meth) acrylate, and neopentyl glycol 1,5-pentanediol di(meth)acrylate; di(meth)acrylate compounds bonded by an alkylene group having an ether bonding such as diethylene glycol di(meth)acrylate, triethylene glycol di(meth)acrylate, tetraethylene glycol di(meth)acrylate, polyethylene glycol (#400) di(meth)acrylate, polyethylene glycol (#600)di(meth)acrylate, and dipropylene glycol di(meth)acrylate. These can be used alone or in combination. Specific examples of other cross-linking agents having two functional groups include, but are not limited to, di(meth)acrylate compounds bonded by an arylene group, or an arylene group having an ether bonding, and polyester type diacrylate compounds.

An example of the polyester type diacrylate compound available in the market is MANDA (Nippon Kayaku Co., Ltd.).

There is no specific limit to the selection of the cross-linking agents having three or more functional groups. Specific examples thereof include, but are not limited to, pentaerythritol tri(meth)acarylate, trimethylol ethane tri(meth) acarylate, trimethylol propane tri(meth)acarylate, tetramethylol methane tetra(meth)acarylate, oligoester (meth)acarylate, triaryl cyanurate, and triayl trimellitate. These can be used alone or in combination.

As the cross-linking agent, aromatic divinyl compound (divinyl benzene in particular), or di(meth)acrylate compounds bonded with an arylene group or an arylene group having one ether bonding arylene group are preferable in terms of the fixing property and anti-offset property of toner.

The content of these cross-linking agents is preferably from 0.01 to 10% by weight and more preferably from 0.03 to 5% by weight based on the monomer.

There is no specific limit to the selection of the polymerization initiators for use in synthesis of the vinyl polymer. Specific examples of such polymerization initiators include, but are not limited to, 2,2'-azobisisobutylo nitrile, 2,2'-azobis (4-methoxy-2,4-dimethyl valero nitrile), 2,2'-azobis(2,4-dimethyl valero nitrile), 2,2'-azobis(2-methylbutylonitrile), dimethyl-2,2'-azobis isobutylate, 1,1'-azobis(1-cyclohexane carbonitrile), 2-(carbamoilazo)isobutylnitrile, 2,2'-azobis(2,4,4-trimethylpentane), 2-phenylazo-2'4'-dimethyl-4'-methoxylvaleronitrile, 2,2'-azobis(2-methylpropane), ketone peroxides such as methylethylketone peroxide, acetylacetone peroxide, and cyclohexanone peroxide; 2,2-bis(tert-butylperoxy)butane, tert-butylhydroperoxide, cumene hydroperoxide, 1,1,3,3-tetramethylbutyl hydroperoxide, di-tert-butyl peroxide, tert-buylcumyl peroxide, α-(tert-butylperoxy)isopropyl benzene, isobutyl peroxide, octanoyl peroxide, decanoyl peroxide, lauloyl peroxide, 3,5,5-trimethyl hexanoyl peroxide, benzoyl peroxide, m-tolyl peroxide, diisopropyl peroxy dicarbonate, bis(2-ethylhexyl)peroxy dicarbonate, di-n-propylperoxy dicarbonate, bis(2-ethoxy ethyl)

peroxy carbonate, bis(ethoxyisopropyl)peroxy dicarbonate, bis(3-methyl-3-methoxybutyl)peroxycarbonate, acetyl cyclohexylsulphonyl peroxide, tert-butyl peroxy acetate, terr-butylperoxy isobutylate, tert-butylperoxy-2-ethylhexalate, tert-butyl peroxy laurate, tert-butyloxy benzoate, tert-butyl peroxy isopropyl carbonate, di-tert-butylperoxy isophthalate, tert-butyl peroxy aryl carbonate, isoamyl peroxy-2-ethylhenanoate, di-tert-butylperoxy hexahydroterephthalate, and tert-butylperoxy azelate. These can be used alone or in combination.

Styrene-(meth)acrylic resins are preferable which has at least one peak in the molecular weight range of from $3\times10^3$ to $5\times10^4$ and at least one peak in the molecular weight range of $1\times10^5$ or greater in the gel permeation chromatography (GPC) chart of tetrahydrofuran (THF) soluble component in terms of fixing property, offset property and preservability of toner.

In addition, in the gel permeation chromatography (GPC) chart of tetrahydrofuran (THF) soluble component, the content of the styrene-(meth)acrylic resin having a molecular weight of $1\times10^5$ or less is preferably from 50 to 90% and the styrene-(meth)acrylic resin having the main peak in the molecular weight range of from $5\times10^3$ to $3\times10^4$ is more preferable and the styrene-(meth)acrylic resin having the main peak in the molecular weight range of from $5\times10^3$ to $2\times10^4$ is particularly preferable.

In the present invention, the molecular weight in the GPC chart is a molecular weight in polystyrene conversion and the developing solvent of GPC is tetrahydrofuran.

The vinyl polymer preferably has an acid value of from 0.1 to 100 mgKOH/g and more preferably from 0.1 to 70 mgKOH/g, and particularly preferably from 0.1 to 50 mgKOH/g.

The polyester can be synthesized by condensation of a diol or higher alcohol and a di- or higher carboxylic acid.

The polyester can be cross-linked by using a triol or higher alcohol and/or a tri- or higher carboxylic acid when synthesizing the polyester.

There is no specific limit to the selection of diols.

Specific examples thereof include, but are not limited to, ethylene glycol, propylene glycol, 1,3-butane diol, 1,4-butane diol, 2,3-butane diol, diethylene glycol, triethylene glycol, 1,5-pentane diol, 1,6-hexane diol, neopenthyl glycol, 2-ethyl-1,3-hexane diol, hydrogenated bisphenol A, and a compound obtained by ring-opening adding a cyclic ether such as ethylene oxide, and propylene oxide to bisphenol A. These can be used alone or in combination.

There is no specific limit to the selection of tri- or higher alcohols. Specific examples thereof include, but are not limited to, sorbitol, 1,2,3,6-hexane tetrol, 1,4-sorbitan, pentaerythritol, dipentaerythritol, tripentaerythritol, 1,2,4-butane triol, 1,2,5-pentane triol, glycerol, 2-methyl propane triol, 2-methyl-1,2,4-butane triol, trimethylol ethane, trimethylol propane, and 1,3,5-trihydroxy methyl benzene. These can be used alone or in combination.

There is no specific limit to the selection of dicarboxylic acids. Specific examples thereof include, but are not limited to, benzene dicarboxylic acid and anhydrides thereof such as phthalic acid, terephthalic acid, and isophthalic acid, alkyl dicarboxylic acids anhydrides thereof such as succinic acid, adipic acid, sebacic acid, and azelaic acid, unsaturated dibasic acid and anhydrides thereof such as maleic acid, citraconic acid, itaconic acid, alkenyl succinic acid, fumaric acid, and mesaconic acid. These can be used alone or in combination.

There is no specific limit to the selection of tri- or higher carboxylic acids. Specific examples thereof include, but are not limited to, trimellitic acid, pyromellitic acid, 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylene carboxypropane, tetrakis(methylene carboxy)methane, 1,2,7,8-octane tetracarboxylic acid, EnPol trimer acid, anhydrides thereof, partially lower alkyl esters thereof. These can be used alone or in combination.

The polyester is preferable which has at least one peak in the molecular weight range of from $3\times10^3$ to $5\times10^4$ in the gel permeation chromatography (GPC) chart of tetrahydrofuran (THF) soluble component in terms of fixing property, and anti-offset property of toner.

In addition, in the gel permeation chromatography (GPC) chart of tetrahydrofuran (THF) soluble component, the content of the polyester having a molecular weight of $1\times10^5$ or less is preferably from 60 to 100% and the polyester more preferably has at least one peak in the molecular weight range of from $5\times10^3$ to $2\times10^4$.

The polyester preferably has an acid value of from 0.1 to 100 mgKOH/g and more preferably from 0.1 to 70 mgKOH/g, and particularly preferably from 0.1 to 50 mgKOH/g.

When the vinyl polymer and/or the polyester is used in combination with other resins, the content of the resin having an acid value of from 0.1 to 50 mgKOH/g is preferably from 60 to 100% by weight based on the entire resin.

The acid value mentioned in the present invention can be measured according to the method described in JIS K0070.

The mother particle preferably has a glass transition temperature of from 35 to 80° C., and more preferably from 40 to 75° C.

When the glass transition temperature is too low, the toner easily deteriorates in a high temperature atmosphere, resulting in occurrence of offset during fixing. When the glass transition temperature is too high, the low temperature fixing property tends to worsen.

Suitable coloring agents (coloring material) for use in the toner of the present invention include known dyes and pigments. Specific examples of the coloring agents include, but are not limited to, carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination.

The content of the coloring agent is preferably from 1 to 15% by weight and more preferably from 3 to 10% by weight based on the toner material.

When a pigment is used as the coloring agent, the toner material preferably contains a pigment dispersion agent having a great compatibility with the resin.

The pigment dispersion agents available in the market include, but are not limited to, Adisper PB821 and Adisper PB822 (manufactured by Ajinomoto Fine-Techno Co., Inc.), Disperbyk-2001 (manufactured by Byk Chemie), and EFKA-4010 (manufactured by EFKA Chemical).

The content of the pigment dispersion agent in the toner material is preferably from 0.1 to 10% by weight based on the weight of the pigment.

When the content is too small, the dispersion property of the pigment tend to deteriorate. When the content is too large, the charging ability of the toner in a high humid environment tends to deteriorate.

The pigment dispersion agent preferably has a molecular weight at the local maximum of the main peak of from 500 to $1\times10^5$, more preferably from $3\times10^3$ to $1\times10^5$, particularly preferably from $5\times10^3$ to $5\times10^4$, and most preferably from $5\times10^3$ to $3\times10^4$ in the GPC chart.

When the molecular weight is too small, the polarity tends to be large, thereby reducing the dispersion property of the pigment. When the molecular weight is too large, the compatibility with the solvent tends to rise, thereby reducing the dispersion property of the pigment.

Master batch pigments, which are prepared by combining a pigment with a resin, can be used as the coloring agent.

There is no specific limit to the selection of the resin for the master batch pigment. Specific examples of the resins for use in the master batch pigments or for use in combination with master batch pigments include, but are not limited to, styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, paraffin waxes, etc. These resins can be used alone or in combination.

The resin for use in the master batch pigment preferably has an acid value of 30 mgKOH/g or less and an amine value of from 1 to 100 mgKOH/g and more preferably an acid value of 20 mgKOH/g or less, and an amine value of from 10 to 50 mgKOH/g.

When the acid value is too large, the charging ability of the toner in a high humidity environment easily deteriorates and the dispersion property of the pigment tends to be insufficient. When the amine value is too small or large, the dispersion property of the pigment tends to be insufficient.

The amine value mentioned in the present invention can be measured according to the method described in JIS K7237.

The master batch pigment can be obtained by applying a high shear stress to a resin and a coloring agent followed by mixing and kneading.

In this case, an organic solvent can be used to boost the interaction of the coloring agent with the resin.

The master batch pigment can be manufactured by using a flushing method.

To be specific, an aqueous paste including a coloring agent is mixed with a resin solution of an organic solvent to transfer the coloring agent to the resin solution and then the aqueous liquid and organic solvent are removed. In this case, the resultant wet cake of the colorant can be used as it is without drying.

When mixing and kneading, a high shear dispersion device such as a three-roll mill, etc. can be preferably used for kneading the mixture.

The content of the master batch pigment in the toner material is preferably from 0.1 to 20% by weight based on the weight of the resin.

There is no specific limit to the selection of the wax. Specific examples thereof include, but are not limited to, aliphatic hydrocarbon based waxes such as a low molecular weight polyethylene, a low molecular weight polypropylene, polyolefin wax, microcrystalline wax, paraffin wax, and sazol wax; oxides of aliphatic hydrocarbon based waxes such as oxidized polyethylene wax or block copolymers thereof; natural vegetable waxes such as candelilla wax, carnauba wax, Japan wax, and jojoba wax; natural animal waxes such as bees was, lanolin, and cetaceum; mineral waxes such as ozocerite, ceresin, and petrolatum; waxes having an aliphatic acid ester such as montan acid ester waxes and castor waxes as its main component; waxes obtained by deacidifying partially or entirely an aliphatic acid such as deacidified carnauba wax: saturated straight chain aliphatic acid such as palmitic acid, stearic acid, and montan acid; unsaturated aliphatic acid such as prandial acid, eleostearic acid, and parinaric acid; saturated alcohols such as stearyl alcohol, eicosyl alcohol, behenyl alcohol, carnauba alcohol, ceryl alcohol, and mesilyl alcohol; polyols such as sorbitol; aliphatic amides such as linoleic acid amides, olefin acid amides, and lauric acid amides; saturated aliphatic bisamides such as methylenebis capric acid amide, ethylenebis lauric acid amide, and hexamethylene bis stearic acid amide; unsaturated aliphatic acid amides such as ethylenebis oleic acid amide, hexamethylenebis oleic acid amide, N,N'-dioleyl adipic acid amide, and N,N'-dioleyl sebacic acid amide; arimatic bisamides such as m-xylenebis stearic acid amide, and N,N-distearyl isophthalic acid amide; apliphatic acid metal salts such as calcium stearate, calcium laurate, zinc stearate, and magnesium stearate; waxes grafted by using a vinyl-based monomer such as styrene or acrylic acid for an aliphatic hydrocarbon based wax; partial esters of an aliphatic acid such as behenic acid monoglyceride and a polyol; methylesters having a hydroxyl group obtained by hydrogen-adding a natural plant oil. These can be used alone or in combination.

Among these, the following is preferable: polyolefins obtained by radical polymerizing an olefin under a high pressure; polyolefins obtained by refining a low molecular weight by-product obtained during a high molecular weight polyolefin polymerization; polyolefins polymerized by using a catalyst such as Ziegler catalyst, and metallocene catalyst; polyolefins polymerized by using radioactive ray, electromagnetic wave, or light; small molecular weight polyolefins obtained by thermal cracking large molecular weight polyolefins; paraffin wax; microcrystalline wax; Fischer-Tropsch wax; synthesized hydrocarbon waxes synthesized by a process such as the Synthol process, the Hydrocol process or the Arge process; Synthesis waxes monomer of which has one carbon atom; hydrocarbon based wax having a functional group such as hydroxyl group, and carboxyl group; mixtures of a hydrocarbon based wax and a hydrocarbon wax having a functional group; and waxes formed by grafting vinyl monomers such as styrene, maleic esters, acrylates, methacrylate, maleic anhydrides to the waxes mentioned above.

In addition, a press sweating process, a solvent method, a re-crystallization method, a vacuum distillation method, a supercritical gas extraction method, or a solution crystallization method is preferably used to obtain a wax having a narrow molecular weight distribution or remove impurities such as a low molecular weight solid aliphatic acid, a low molecular weight solid alcohol, and a low molecular weight solid compound.

The melting point of the wax is preferably from 70 to 140° C., and more preferably from 70 to 120° C. When the melting point is too low, the blocking resistance tends to degrade. When the melting point is too high, the anti-offset property tends to be insufficient.

In the present invention, the melting point can be measured by a differential scanning calorimeter (DSC) of a high precision internally heated input compensation type and is represented by the peak top of the maximum endothermic peak of the DSC curve. The melting point is measured according to ASTM D3418-82 in which a sample is heated and cooled down to obtain previous history and heated again at 10° C./min to obtain the DSC curve.

In addition, by using a combination of waxes having different melting points of from 10 to 100° C., the waxes can demonstrate both plasticizing function and releasing function.

The wax that demonstrates the plasticizing function has a relatively low melting point and includes a branch structure with a polarization group. The wax that demonstrates the releasing function has a relatively high melting point and includes a straight-chain structure with no polarity (no polarization group).

The melting point of at least one of the waxes is preferably from 70 to 120° C., and more preferably from 70 to 100° C.

Specific examples of such combinations of waxes include, but are not limited to, a combination of a polyethylene homopolymer or co-polymer having ethylene as the main component and a polyolefin homo-polymer or co-polymer having polyolefin except for ethylene as the main component, a combination of a polyolefin and a graft modified polyolefin, a combination of an alcohol wax, an aliphatic acid wax, or an ester wax, and a hydrocarbon wax, a combination of Fischer-Tropsch wax or polyolefin wax, and paraffin wax or microcrystalline wax, a combination of Fischer-Tropsch wax and a polyolefin wax, a combination of paraffin wax and microcrystalline wax, and a combination of carnauba wax, candelilla wax, rice wax or montan wax, and a hydrocarbon based wax.

The content of the wax in the toner material is preferably from 0.2 to 20% by weight and more preferably from 0.5 to 10% by weight based on the resin.

There is no specific limit to the selection of the magnetic substance. Specific examples thereof include, but are not limited to, magnetized iron oxides or iron oxides containing other metal oxides such as magnetite, maghemite, and ferrite; and metals such as iron, cobalt, and nickel or alloys thereof with metals such as aluminum, cobalt, copper, lead, magnesium, tin, zinc, antimony, beryllium, bismuth, cadmium, calcium, manganese, selenium, titanium, tungsten, and vanadium. These can be used alone or in combination.

Specific examples of the magnetic substances include, but are not limited to, $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, and nickel powder. Among these, $Fe_3O_4$ and $\gamma$-$Fe_2O_3$ are preferable.

Also, magnetized iron oxides such as magnetite, maghemite, and ferrite that contain other elements can be used as the magnetic substance.

There is no specific limit to the selection of the other elements. Specific examples thereof include, but are not limited to, lithium, berylium, boron, magnesium, aluminum, silicon, phosphine, germanium, zirconium, tin, sulfur, calcium, scandium, titanium, vanadium, chrome, manganese, cobalt, nickel, copper, zinc, or gallium. The other elements can be taken in the crystalline lattice of the iron oxide or can be present on the surface of the iron oxide as an oxide or hydroxide. Preferably, the other elements are taken inside the iron oxide as an oxide.

The other elements can be taken into the magnetic substance by mixing a salt of the other elements during preparation of the magnetic substance and adjusting pH. The other elements can be present on the surface of the magnetic substance by adjusting pH or adding a salt of the other elements to adjust pH after preparation of the magnetic substance.

The magnetic substance preferably has a number average particle diameter of from 0.1 to 2 μm and more preferably from 0.1 to 0.5 μm.

The number average particle diameter can be obtained by measuring a zoom-in photograph taken by a transmission electron microscope by a digitizer.

In addition, the magnetic substance preferably has a coercivity of from 20 to 1,500 e, a saturated magnetization of from 50 to 200 emu/g, and a residual magnetization of from 2 to 20 emu/g when a magnetic field of 10 kOe is applied to the magnetic substance.

The content of the magnetic substance in the toner material is preferably from 10 to 200 parts by weight and more preferably from 20 to 150 parts by weight base on 100 parts by weight of the resin.

The magnetic substance can be also used as the coloring agent.

In the present invention, the mother toner T can be used as the toner. An external additive such as a fluidizer and a cleaning property improver can be attached to the mother toner T.

There is no specific limit to the selection of the fluidizer. Specific examples thereof include, but are not limited to, carbon black, fluorine based resins such as polytetrafluoroethylene, silica manufactured by a wet or dry method, titanium oxide, alumina and hydrophobized compounds thereof.

Among these, silica, titanium oxide and alumina are preferable and silica hydrophobized by a silane compound is more preferable.

Silica manufactured by a dry method is produced by gas-phase oxidization of halogenated silicon.

Specific examples thereof include, but are not limited to, AEROSIL-130, 300, 380, TT600, MOX170, MOX80, and COK84 (all of those are manufactured by Nippon Aerosil Co., Ltd.), Ca-O-Sil-M-5, MS-7, MS-75, HS-5, and EH-5 (all of those manufactured by Cabot Corporation), Wacker HDK-N20, V-15, N20E, T30, and T40 (all of those Wacker-Chemie AG), D-CFineSilica (Dow Corning Corporation), and Fransol (manufactured by Fransil Co. Ltd.).

The fluidizer preferably has a number average particle diameter of from 5 to 100 μm and more preferably from 5 to 50 μm.

The fluidizer preferably has a specific surface area of 20 $m^2/g$ or more, and more preferably from 60 to 400 $m^2/g$ according to BET method.

The hydrophobized fluidizer preferably has a specific surface area of 20 $m^2/g$ or more, and more preferably from 40 to 300 $m^2/g$ according to BET method.

Silica hydrophobized by a silane compound is that a silane compound is chemically or physically adsorbed and preferably has a hydrophobization degree of from 30 to 80% (methanol wettability, methanol titration, an index of wettability to methanol).

Specific examples of the silane compounds include, but are not limited to, hydroxypropyl trimethoxy silane, phenyltrimethoxysilane, n-hexadecyl trimethoxy silane, n-octadecyl trimethoxy silane, vinylmethoxy silane, vinyl triethoxy silane, vinyl triacetthoxy silane, dimethylvinylchloro silane, divinylchloro silane, γ-methacryloyloxy propyl trimethoxy silane, hexamethyl disilane, trimethyl silane, trimethyl chlorosilane, dimethyldichlorosilane, methyl trichlorosilane, dimethyldichlorosilane, methyltrichloro silane, aryldimethylchloro silane, arylphenyl dichloro silane, benzildimethylchloro silane, bromomethyl dimethylchloro silane, α-chloroethyl trichloro silane, chloroethyl trichloro silane, chloromethyldimethylchloro silane, triorganosilyl mercaptan, trimethyl silyl mercaptan, triorganosilyl acrylate, vinyldimethylacethoxy silane, dimethylethoxy silane, trimethyl ethoxy silane, trimethyl methoxy silane, methyl triethoxy silane, isobutyl trimethoxy silane, dimethyldimethoxy silane, diphenyldiethoxy silane, hexamethyl disiloxane, 1,3-divinyl tetramethyl disiloxane, and 1,3-diphenyltetramethyl disiloxane.

Among these, dimethyl polysiloxane, which has 2 to 12 siloxane units with one silanol group at most at their ends, is preferable. Other silane compounds are, for example, silicone oils such as dimethyl silicone oil.

The addition amount of the fluidizer is preferably from 0.03 to 8% by weight based on the mother toner T.

The toner for use in the present invention may include a cleaning improver to remove the toner (development agent) remaining on an image bearing member such as a photoreceptor and an intermediate transfer body. Specific examples of the cleaning improvers include, but are not limited to, zinc stearate, calcium stearate and metal soaps of stearic acid; polymer particulates such as polymethyl methacrylate particulates and polystyrene particulates, which are prepared by a soap-free emulsion polymerization method or the like, etc.

The polymer particulates preferably have a narrow particle size distribution and the weight average particle diameter thereof is preferably from 0.01 to 1 μm.

When the eternal additive is added, a mixer such as a v-type mixer, a rocking mixer, a Loedige Mixer, a Nauta mixer or a Henschel mixer can be used.

It is preferable that such a mixer be equipped with a jacket and the like to adjust the internal temperatures thereof.

In order to change stresses on the external additive, the external additive may be added in separate times or step by step. It is also possible to change stress by varying the number of rotation, tumbling speed, mixing time and temperature. For example, a method in which a strong stress is first applied and then a relatively weak stress is applied, or vice versa can be used.

The following can be added to the toner related to the present invention, if desired: various kinds of metal soaps, fluorine based surface active agents, and dioctyl phthalate to protect an image bearing member (latent electrostatic image bearing member) and a carrier, improve the cleaning property, adjust the thermal characteristics, electric characteristics, physical characteristics, the resistance, the softening point, and improve the fixing ratio, and inorganic powder such as tin oxide, zinc oxide, carbon black, antimony oxide, and titanium oxide, alumina as an electroconductivity imparting agent.

The inorganic powder can be hydrophobized, if desired.

In addition, a lubricant such as polytetrafluoroethylene, zinc stearate, and polyvinylidene fluoride, an abrasive such as cesium oxide, silicon carbide, and strontium titanate, a caking prevention agent, and white or black particulates having a polarity reverse to that of the toner particles as a development improver can be suitably used.

These additives are preferably subject to treatment by a treatment agent such as silicone varnish, various kinds of modified silicone varnishes, silicone oil, various kinds of modified silicone oils, silane coupling agents, silane coupling agents having a functional group, and other organic silicon compounds to control the charging amount, etc.

In the present invention, the toner can be used as a single component development agent, or can be mixed with a carrier and used as a two component development agent.

Core particles or core particles the surface of which is covered with a resin can be used as the carrier.

There is no specific limit to the selection of the core particles. Specific examples thereof include, but are not limited to, oxides such as ferrite, iron excessive type ferrite, magnetite, and γ-iron oxide; and magnetic materials such as metals such as iron, cobalt, and nickel, and their alloys.

Specific examples of elements contained in the magnetic materials include, but are not limited to, iron, cobalt, nickel, aluminum, copper, lead, magnesium, tin, zinc, antimony, beryllium, bismuth, calcium, manganese, selenium, titanium, tungsten, and vanadium.

Among these, copper-zinc-iron based ferrite having copper, zinc and iron as the main component, and manganese-magnesium-iron based ferrite having manganese, magnesium and iron as the main component are preferable.

Other core particles are, for example, resins in which magnetic materials are dispersed.

There is no specific limit to the selection of the resins that cover the surface of the core particles include, but are not limited to, styrene-acrylic acid based resins such as copolymers of styrene-acrylic acid ester, and copolymers of styrene-methacrylic acid ester; acrylic based resins such as copolymers of acrylic acid esters, and copolymers of methacrylic acid esters; fluorine resins such as polytetrafluoroethylene, polychlorotrifluoroethylene, and polyvinylidene fluoride; silicone resins, polyester, polyamide, polyvinyl butyral, aminoacrylates resins, ionomer resins, and polyphenylene sulfides.

Among these, copolymers of styrene-methyl methacrylate, a mixture of a resin containing fluorine and a styrene-based copolymer, and silicone resins are preferable and silicone resins are particularly preferable.

Specific examples of the mixture of a resin containing fluorine and a styrene-based copolymers include, but are not limited to, a mixture of polyvinylidene fluoride and a copolymer of styrene and methyl methacrylate, a mixture of polytetrafluoroethylene and a copolymer of styrene and methyl methacrylate, and a mixture of a copolymer of vinylidene fluoride and tetrafluoroethylene (weight ratio in copolymer: 10/90 to 90/10), a copolymer of styrene and acrylic acid 2-ethyl hexyl (weight ratio in copolymer: 10/90 to 90/10), and a copolymer of styrene-acrylic acid 2-ethyl hexyl-methyl methacrylate (weight ratio in copolymer: 20 to 60/5 to 30/10 to 50).

A specific example of the silicone resins is a modified silicone resin prepared by reacting a nitrogen containing silicone resins, a nitrogen containing silane coupling agent and a silicone resin.

The content of the resin in the carrier is preferably from 0.01 to 5% by weight and more preferably from 0.1 to 1% by weight.

There is no specific limit to the selection of the method of covering the surface of the core particle with a resin. Specific examples thereof include, but are not limited to, a method of coating a resin solution or liquid dispersion on the core particle and a method of mixing the core particle with resin particles.

The carrier preferably has a volume resistivity of from $10^5$ to $10^{10}$ Ω·cm.

The carrier preferably has a particle diameter of from 4 to 200 μm, more preferably from 10 to 150 μm, and furthermore preferably from 20 to 100 μm. In addition, the carrier having a core particle covered with a resin has a 50% particle diameter of from 20 to 70 μm.

In the two component development agent, toner is preferably mixed with 100 parts by weight of carrier in an amount of 1 to 200 parts by weight and more preferably from 2 to 50 parts by weight.

In the present invention, there is no specific limit to the selection of the latent electrostatic image bearing members when developing electrostatic images in electrophotography, electrostatic recording, electrostatic printing, etc. with a single component development agent or a two component development agent. Specific examples thereof include, but are not limited to, latent electrostatic image bearing members such as an organic latent electrostatic image bearing member, a non-amorphous silica latent electrostatic image bearing member, a selenium latent electrostatic image bearing member, and a zinc oxide latent electrostatic image bearing member.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Toner Liquid Material 17 parts of carbon black (Regal 400, manufacture by Cabot Corporation), 3 parts of pigment dispersion agent (Adisper PB821, manufactured by Ajinomoto Fine-Techno Co., Inc.) and 80 parts of ethyl acetate are primarily dispersed by a mixer having stirring wings.

The thus obtained primary liquid dispersion is secondarily dispersed using Dyno-Mill (manufactured by Willy A. Bachofen AG) to remove agglomeration bodies having a particle diameter of 5 μm or greater so that a pigment liquid dispersion is obtained.

18 parts of carnauba wax, 2 parts of a wax dispersion agent and 80 parts of ethyl acetate are primarily dispersed by a mixer having stirring wings.

The wax dispersion agent is prepared by grafting polyethylene wax with a copolymer of styrene-butyl acrylate.

The primary liquid dispersion is heated to 80° C. while stirring to dissolve carnauba wax and then cooled down to room temperature so that precipitated carnaub wax has a maximum particle diameter of 3 μm or less.

Furthermore, the wax liquid dispersion is secondarily dispersed using Dyno-Mill (manufactured by Willy A. Bachofen AG) to adjust so that precipitated carnauba wax has a maximum particle diameter of 2 μm or less.

100 parts of polyester, 30 parts of a pigment liquid dispersion, 30 parts of a wax liquid dispersion, and 840 parts of ethyl acetate are uniformly dispersed by 10-minute stirring to prepare a toner liquid material.

The toner liquid material has an electric conductivity of from $1.8\times10^{-7}$ S/m and a density of 1.18 g/cm$^3$.

Example 1

The toner liquid material is supplied by the pump 152 from the tank 151 to the droplet discharging unit 110.

The thin film 111*a* of the retainer retaining member 111 is manufactured by SOI (Silicon on Insulator), using an etching method (refer to FIG. 8).

The diameters $D_1$ and $D_2$ of the discharge orifices are 120 μm and 10 μm, respectively and the thicknesses $W_1$ and $W_2$ of the thin film 111*a* are 400 μm and 15 μm, respectively.

The thin film 111*a* has a resonance frequency of 85 kHz. The resonance frequency is measured by PSV300 (manufactured by Nippon Polytech Corp.).

In addition, the retaining member 111 has six of the retainer areas 111*c* separated by the shield 111*b*. Each of the retainer areas 111*c* has a hound's-tooth discharge orifice with a pitch of 200 μm in the center area of 5 mm×5 mm. Furthermore, a resin coating laminate biezoactuator (manufactured by NEC Torkin Corporation) having a primary resonance frequency of 138 kHz is used as the piezoelectrici body 112*a*. When the primary resonance frequency f of the piezoelectric body 112*a* in the droplet discharging unit 110 is 62.5 kHz. Nitrogen gas is flown into the flow passage 116 at a speed of 2 litter/minute and the average linear velocity of the nitrogen gas around the discharge orifice is 20 m/s.

In addition, nitrogen gas is also flown into the drying tower 120 at a speed of 30 litter/minute. The dew point of the nitrogen gas at the time is −20° C. and the temperature of the drying tower 120 is from 27 to 28° C.

The power source 115 applies a pulse voltage having a trapezoid waveform at 20 kHz to the piezoelectric body 112*a* to discharge the toner liquid material and then the drying tower 120 is dried to manufacture the mother particle T. The mother particle T is collected at the collection unit 130 by using a filter having a fine pore diameter of 1 μm and retained at the retainer 140. The reference voltage V of the pulse voltage is 2 V. $T_1$, $T_2$, and $T_3$ are set to be 4 μ/s, 10 μ/s, and 4 μ/s, respectively. The discharging speed of the droplet L is 2.3 m/s.

In addition, the mother particle T retained in the retainer 140 three hours after the toner manufacturing starts has a weight average particle diameter D4 of 5.3 μm, and a ratio (the weight average particle diameter D4 to the number average particle diameter Dn) of 1.08.

Method of Measuring Particle Size Distribution of Mother Particle

A few droplets of nonion based surface active agent (Contaminon N, manufactured by Wako Pure Chemical Industries, Ltd.) and 5 mg of the mother particle are added in 10 ml of water in which the density of particles having a diameter corresponding to a circle of from 0.60 to less than 159.21 μm obtained by removing fine dust through a filter is 20 particles/$10^{-3}$ $cm^3$ or less.

Next, the solution is subject to dispersion treatment for 5 minutes in total using an ultrasonic dispersion machine (UH-50, manufactured by SMT Co., Ltd.) under conditions of 20 kHz, and 50 W/10 $cm^3$ for one minute dispersion treatment to prepare a liquid dispersion in which the density of particles having a diameter corresponding to a circle of from 0.60 to less than 159.21 μm is 4,000 to 8,000 particles/$10^{-3}$ $cm^3$ or less. Then, the particle size distribution of the liquid dispersion is measured.

To be specific, the liquid dispersion is caused to flow a flow passage provided along the current direction of a flat and oblate transparent cell having a thickness of about 200 μm.

A strobe light and a CCD camera are provided opposite to each other relative to the thickness direction of the flow cell to form a light path that crosses the direction of the thickness of the flow cell. While the liquid dispersion is flowing, the strobe light flashes at a 1/30 second interval to obtain particle images flowing in the flow cell. Consequently, the mother particles are photographed as two dimensional images parallel to the flow cell and the diameter of a circle having the same area as the two dimensional image is calculated as the circle correspondent diameter.

The range of from 0.06 to 400 μm is divided into 226 channels and the circle correspondence diameters of 1,200 or more mother particles are calculated in about one minute.

Measuring Method of Discharging Speed of Toner Liquid Material

An LED is flashed in synchronization with the timing of discharging the toner liquid material from the discharge orifice and the droplet L around the discharge orifice is observed with a microscope. The discharging speed of the toner liquid material is calculated by recording the time taken for the toner liquid material to move 100 μm after it is discharged.

To be specific, the average of the discharging speed of the toner liquid material is calculated for 6 discharge orifices situated in the center of the thin film among the multiple discharge orifices.

Example 2

A toner (of Comparative Example 2) is prepared in the same manner as in Example 1 except that the frequency of the pulse voltage having a trapezoid waveform is 30 kHz, and the reference voltage V is 5 V and $T_1$, $T_2$, and $T_3$ are set to be 4 μ/s, 4 μ/s, and 2 μ/s, respectively. The discharging speed of the toner liquid material is 3.5 m/s.

In addition, the mother particle T retained in the retainer 140 three hours after the toner manufacturing starts has a weight average particle diameter D4 of 5.2 μm, and a ratio (the weight average particle diameter D4 to the number average particle diameter Dn) of 1.05.

Example 3

A toner (of Example 3) is prepared in the same manner as in Example 1 except that the frequency of the pulse voltage having a trapezoid waveform is 5 kHz, and the reference voltage V is 4 V and $T_1$, $T_2$, and $T_3$ are set to be 10 μ/s, 10 μ/s, and 10 μ/s, respectively.

The discharging speed of the toner liquid material is 4.0 m/s.

In addition, the mother particle T retained in the retainer 140 three hours after the toner manufacturing starts has a weight average particle diameter D4 of 5.2 μm, and a ratio (the weight average particle diameter D4 to the number average particle diameter Dn) of 1.02.

Comparative Example 1

A toner (of Comparative Example 1) is prepared in the same manner as in Example 1 except that the frequency of the pulse voltage having a trapezoid waveform is 10 kHz, and the reference voltage V is 4 V and $T_1$, $T_2$, and $T_3$ are set to be 6 μ/s, 10 μ/s, and 6 μ/s, respectively. The discharging speed of the toner liquid material is 4.5 m/s. In addition, the mother particle T retained in the retainer 140 three hours after the toner manufacturing starts has a weight average particle diameter D4 of 5.2 μm, and a ratio (the weight average particle diameter D4 to the number average particle diameter Dn) of 1.09.

Comparative Example 2

A toner (of Comparative Example 2) is prepared in the same manner as in Example 1 except that the frequency of the pulse voltage having a trapezoid waveform is 30 kHz, and the reference voltage V is 5 V and $T_1$, $T_2$, and $T_3$ are set to be 2 μ/s, 10 μ/s, and 2 μ/s, respectively. The discharging speed of the toner liquid material is 6.8 m/s.

In addition, the mother particle T retained in the retainer 140 three hours after the toner manufacturing starts has a weight average particle diameter D4 of 4.6 μm, and a ratio (the weight average particle diameter D4 to the number average particle diameter Dn) of 1.35.

Comparative Example 3

A toner (of Comparative Example 3) is prepared in the same manner as in Example 1 except that the frequency of the pulse voltage having a trapezoid waveform is 20 kHz, and the reference voltage V is 10 V and $T_1$, $T_2$, and $T_3$ are set to be 3 μ/s, 10 μ/s, and 3 μ/s, respectively. The discharging speed of the toner liquid material is 10.6 m/s.

In addition, the mother particle T retained in the retainer 140 three hours after the toner manufacturing starts has a weight average particle diameter D4 of 3.8 μm, and a ratio (the weight average particle diameter D4 to the number average particle diameter Dn) of 1.75.

Manufacturing of Toner

A toner is manufactured by mixing the mother particle and 1.0% by weight hydrophobic silica H2000 (manufactured by Clariant Japan K.K.) with Henschel Mixer (Nippon coke & Engineering Co., Ltd.).

Manufacturing of Development Agent

A silicone resin is dispersed in toluene to form a liquid dispersion. Then, the liquid dispersion is spray-coated to spherical ferrite particles having an average particle diameter of 50 μm while the liquid dispersion is heated. Thereafter, the resultant is baked, and cooled down to form a coating layer having a thickness of 0.2 μm and thus a carrier is obtained.

Next, 4 parts of the toner of Example or Comparative Example and 96 parts of the carrier are mixed to obtain a development agent.

Evaluation of Fine Line Reproducibility

The development agent is set in a remodeled photocopier with regard to the development unit based on a photocopier (imagio neo 271, manufactured by Ricoh Co., Ltd.) and images having an image ratio of 7% are formed on a recording medium (6000 paper, manufactured by Ricoh Co., Ltd.). 10th image and 30,000th image are compared with the original with regard to the fine line portions.

To be specific, the image is enlarged and observed by an optical microscope with a magnifying power of 100 times and omission of the status of the fine line portion is compared with the sample at each stage and evaluated according to 4 levels.

The evaluation results are shown in Table 1.

TABLE 1

| | Discharging speed of toner liquid material (m/s) | D4 (weight average particle diameter) of mother particle (μm) | D4/Dn (number average particle diameter) of mother particle | Fine line reproducibility |
|---|---|---|---|---|
| Example 1 | 2.3 | 5.3 | 1.08 | Excellent |
| Example 2 | 3.5 | 5.2 | 1.05 | Good |
| Example 3 | 4.0 | 5.2 | 1.02 | Excellent |
| Comparative Example 1 | 4.5 | 5.2 | 1.09 | Fair |
| Comparative Example 2 | 6.8 | 4.6 | 1.35 | Bad |
| Comparative Example 3 | 10.6 | 3.8 | 1.75 | bad |

Evaluation of "Bad" in Table 1 means unsuitable as a product.

The toners of Examples have a small particle size distribution so that the fine line reproducibility is good or excellent.

This document claims priority and contains subject matter related to Japanese Patent Application No. 2009-168131, filed on Jul. 16, 2009, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of manufacturing a toner comprising:

supplying a fluid comprising a resin and a coloring agent to a retaining member comprising a film having multiple discharge orifices therein;

discharging droplets of the fluid from the multiple discharge orifices at a speed of from 2 to 4 m/sec by applying a pulse voltage having a trapezoid waveform to a piezoelectric body having a surface portion provided substantially parallel to the film to move the surface in a direction away from the film relative to an at-rest reference position of the surface, holding the surface thereat for a predetermined time, and bringing the surface back to the reference position; wherein the pulse voltage having a trapezoid waveform has a frequency smaller than a resonance frequency of the film; and solidifying droplets of the fluid discharged from the multiple discharge orifices to form mother particles;

wherein the piezoelectric body has a primary resonance frequency f, which satisfies the following relationship:

$N-0.1<4fT_1<N+0.1$;

wherein N represents an integer, and $T_1$ represents a time required for the pulse voltage to be decreased from the reference voltage V to 0.

2. The method of manufacturing a toner according to claim 1, wherein a flow of gas is formed outside the retaining member such that the gas flows in substantially the same direction as a direction of the fluid discharged from the multiple discharge orifices, wherein the flow of gas is restricted by a restricting member provided near the multiple discharge orifices.

3. The method of manufacturing a toner according to claim 1, wherein the fluid further comprises an organic solvent, the method further comprising the step of drying the droplets discharged from the multiple discharge orifices by removing the organic solvent.

4. The method of manufacturing a toner according to claim 3, further comprising transferring the droplets of the fluid discharged from the multiple discharge orifices by using a drying gas flowing in substantially the same direction as a direction of discharging the droplets.

5. The method of manufacturing a toner according to claim 1, wherein the mother particles have a ratio (D4/Dn) of a weight average particle diameter D4 to a number average particle diameter Dn of from 1.00 to 1.15.

6. The method of manufacturing a toner according to claim 1, wherein the mother particles have a weight average particle diameter D4 of from 1 to 20 μm.

7. The method of manufacturing a toner according to claim 1, wherein the film is made of Silicon on Insulator (SOI).

8. The method of manufacturing a toner according to claim 1, wherein the pulse voltage having a trapezoid waveform is down from a reference voltage V to 0 in a time T1, sustained at 0 for a time T2, and back to the reference voltage V in a time T3, and a total time of T1+T3 is longer than T2.

9. A method of manufacturing a toner comprising:

supplying a fluid comprising a resin and a coloring agent to a retaining member comprising a film having multiple discharge orifices therein;

discharging droplets of the fluid from the multiple discharge orifices at a speed of from 2 to 4 m/sec by applying a pulse voltage having a trapezoid waveform to a piezoelectric body having a surface portion provided substantially parallel to the film to move the surface in a direction away from the film relative to an at-rest reference position of the surface, holding the surface thereat for a predetermined time, and bringing the surface back to the reference position; wherein the pulse voltage having a trapezoid waveform has a frequency smaller than a resonance frequency of the film, and wherein the pulse voltage having a trapezoid waveform is down from a reference voltage V to 0 in a time T1, sustained at 0 for a time T2, and back to the reference voltage V in a time T3, and a total time of T1+T3 is longer than T2; and solidifying droplets of the fluid discharged from the multiple discharge orifices to form mother particles.

10. The method of manufacturing a toner according to claim 9, wherein a flow of gas is formed outside the retaining member such that the gas flows in substantially the same direction as a direction of the fluid discharged from the multiple discharge orifices, wherein the flow of gas is restricted by a restricting member provided near the multiple discharge orifices.

11. The method of manufacturing a toner according to claim 9, wherein the fluid further comprises an organic solvent, the method further comprising the step of drying the droplets discharged from the multiple discharge orifices by removing the organic solvent.

12. The method of manufacturing a toner according to claim 11, further comprising transferring the droplets of the fluid discharged from the multiple discharge orifices by using a drying gas flowing in substantially the same direction as a direction of discharging the droplets.

13. The method of manufacturing a toner according to claim 9, wherein the mother particles have a ratio (D4/Dn) of a weight average particle diameter D4 to a number average particle diameter Dn of from 1.00 to 1.15.

14. The method of manufacturing a toner according to claim 9, wherein the mother particles have a weight average particle diameter D4 of from 1 to 20 μm.

15. The method of manufacturing a toner according to claim 9, wherein the film is made of Silicon on Insulator (SOI).

* * * * *